United States Patent [19]

Bell, Jr. et al.

[11] 4,188,898

[45] Feb. 19, 1980

[54] SYSTEM FOR COMBINING STOCKING MATERIALS AND GUSSETS TO FORM PANTY HOSE GARMENTS

[75] Inventors: Cecil R. Bell, Jr., Pinnacle; George D. Nakhle, Winston-Salem; Arthur R. Edwards, Winston-Salem; Walter R. Sizemore, Winston-Salem, all of N.C.

[73] Assignee: Takatori Machinery Mfg. Co., Ltd., Asahi Minami, Japan

[21] Appl. No.: 830,421

[22] Filed: Sep. 6, 1977

[51] Int. Cl.[2] ..... D05B 1/00

[52] U.S. Cl. ..... 112/262.1; 112/121.15

[58] Field of Search ..... 112/121.11, 121.12, 112/121.15; 223/112, 43

[56] References Cited

U.S. PATENT DOCUMENTS

| | | | |
|---|---|---|---|
| 1,575,887 | 3/1926 | Zimmerman | 112/121.15 |
| 2,702,014 | 2/1955 | Brownstein | 112/121.15 |
| 3,669,047 | 6/1972 | Hedegaard | 112/121.5 |
| 3,675,247 | 7/1972 | Ferrell | 2/409 |
| 3,777,681 | 12/1973 | Horita | 112/121.15 |
| 3,799,082 | 3/1974 | Redman . | |

*Primary Examiner*—Ronald Feldbaum
*Attorney, Agent, or Firm*—Kenyon & Kenyon

[57] ABSTRACT

A pair of aligned stocking materials having hip portions are severed a prescribed distance, and a pair of template assemblies spread the stockings until the severed edges of each of the stocking materials define generally straight lines. A gusset is positioned adjacent the stretched severed edges and seamed sequentially along the edges of each of the pair of stocking materials by sewing machines to form a panty hose garment.

21 Claims, 21 Drawing Figures

SYSTEM FOR COMBINING STOCKING MATERIALS AND GUSSETS TO FORM PANTY HOSE GARMENTS

BRIEF SUMMARY AND OBJECTS OF THE INVENTION

U.S. Pat. No. 3,777,681 dated Dec. 11, 1973 to Teruyuki Horita discloses a Seaming Method and Apparatus For Goreless Panty Hoses.

In the Horita Patent a pair of stocking materials are mounted upon template assemblies which, in turn, are carried by a rotating unit circulating along an endless guide rail. The stocking materials are gripped by the template assemblies and partially severed by a cutter mechanism. The template assemblies then pivot or rotate to substantially straighten and expose the severed edges of the stocking material. The exposed severed edges are seamed by a sewing machine into a goreless panty hose.

The present invention relates to a new and improved system for sewing a gusset to severed edge portions of a pair of stocking materials to form a panty hose garment.

To carry out the gusset sewing system according to the present invention, a template assembly is mounted upon a rotating unit circulating along an endless guide rail, basically as described and as illustrated by FIGS. 2, 3, 4A and 4B of the Horita patent. The nipping templates or clamps upon the template assembly of the Horita patent have been replaced with positive compound clamping assemblies for individually clamping each of the pair of stocking materials.

The clamped stocking materials are severed, and the clamping assemblies pivoted to spread the severed edge portions of the stocking materials, both upper and lower, into generally straight lines. A gusset is loaded on top of the clamping assemblies manually or automatically and the clamping assemblies are actuated in a prescribed manner to pull back the severed edges of the upper stocking material or blank. The gusset is sewn to the bottom stocking material or blank as it is displaced passed a conventional sewing machine. The clamping assemblies again are actuated and the gusset is turned for sewing, by a second conventional machine, to the top stocking material or blank. The completed panty hose may then be doffed after pivoting of the clamping assemblies to their original positions and release of the panty hose.

One of the primary objects of the invention is the provision of a new and improved system for combining a gusset with a pair of stocking materials to form a panty hose garment.

Still another object of the invention is the provision of a system for forming a panty hose garment having a gusset which increases production while reducing expense since less skill is required in forming the garment.

An important feature of the invention is the provision of a clamping arrangement which accurately shifts and controls the severed portions of upper and lower panty hose blanks for proper alignment with a gusset to insure the desired stitching performance without control by an operator.

Other features and advantages of the invention will be readily apparent to those skilled in the art during the course of the following description of the invention.

DETAILED DESCRIPTION OF THE INVENTION

Figure 9:
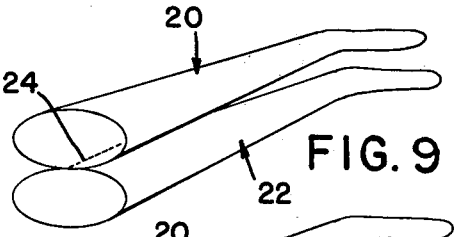
FIG. 9 is a schematic, perspective view of a pair of aligned stocking materials prior to severing.
Figure 10:
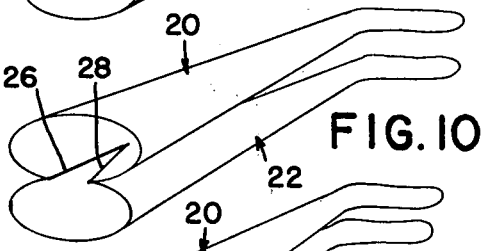
FIG. 10 is a view similar to FIG. 9 with the stocking materials severed.
Figure 11:
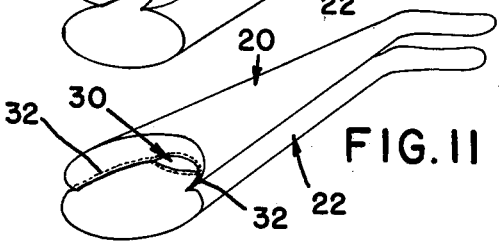
FIG. 11 is a view similar to FIGS. 9 and 10 illustrating the gusset sewn to the severed edges of the stocking materials forming a panty hose garment.

Referring initially to FIGS. 9–11, the basic steps of forming the panty hose garment having a gusset have been illustrated. A pair of stocking materials 20 and 22, each including a hip portion, are aligned with the hip portions located one above the other and held in position. The stocking materials then are severed along line 24 defining edges 26, 28. After the materials have been severed, the stocking materials are spread laterally until the severed edges 26, 28 defined slightly curved but generally straight lines. A gusset 30 is sewn first to one and then to the other of the stocking materials adjacent the severed edged 26, 28 to form the garment in FIG. 11.

Figure 1:
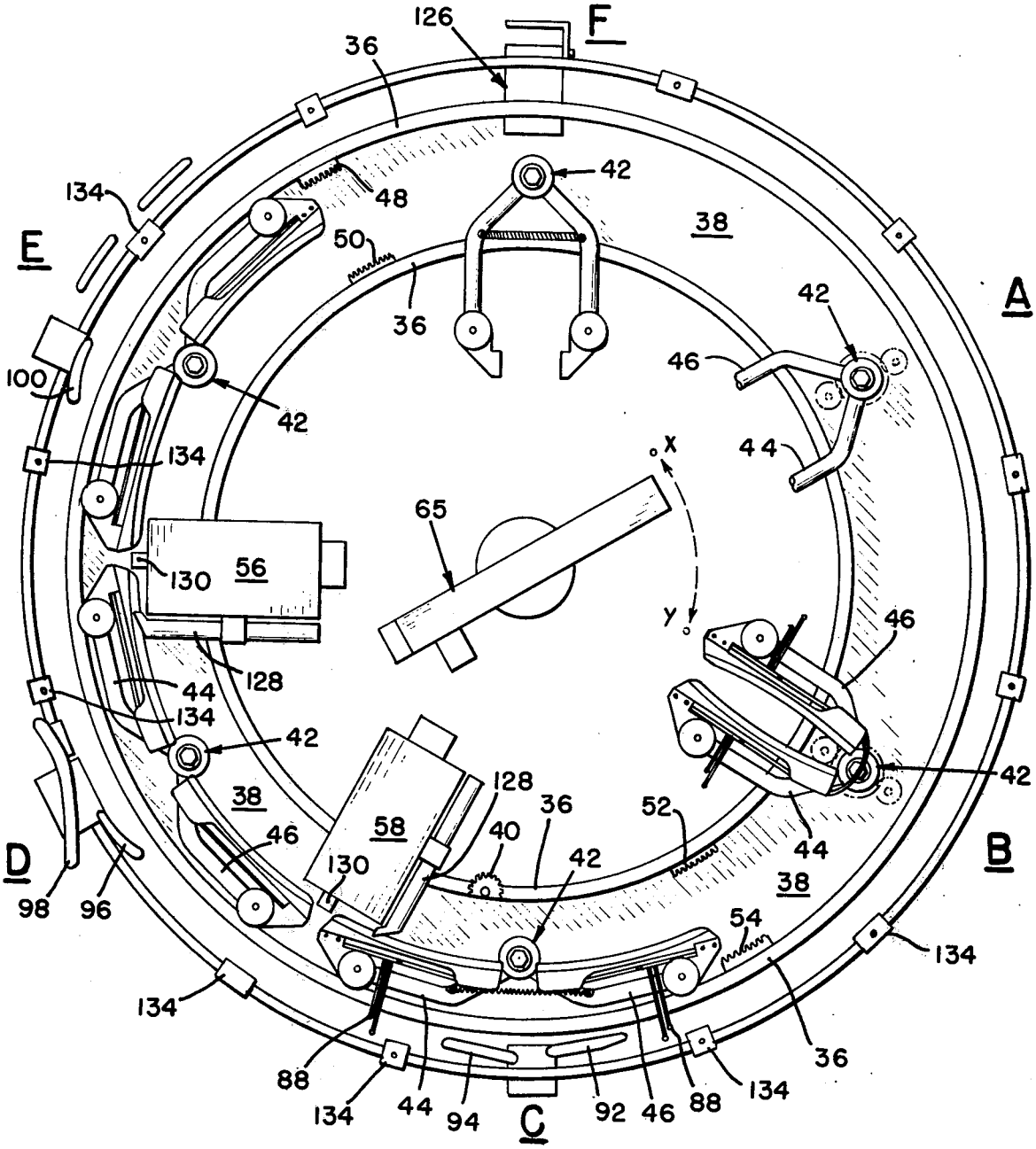
FIG. 1 is a schematic, fragmentary, top plan view of the apparatus of the present invention for combining two stocking materials with a gusset to form a panty hose garment.
Figure 2:
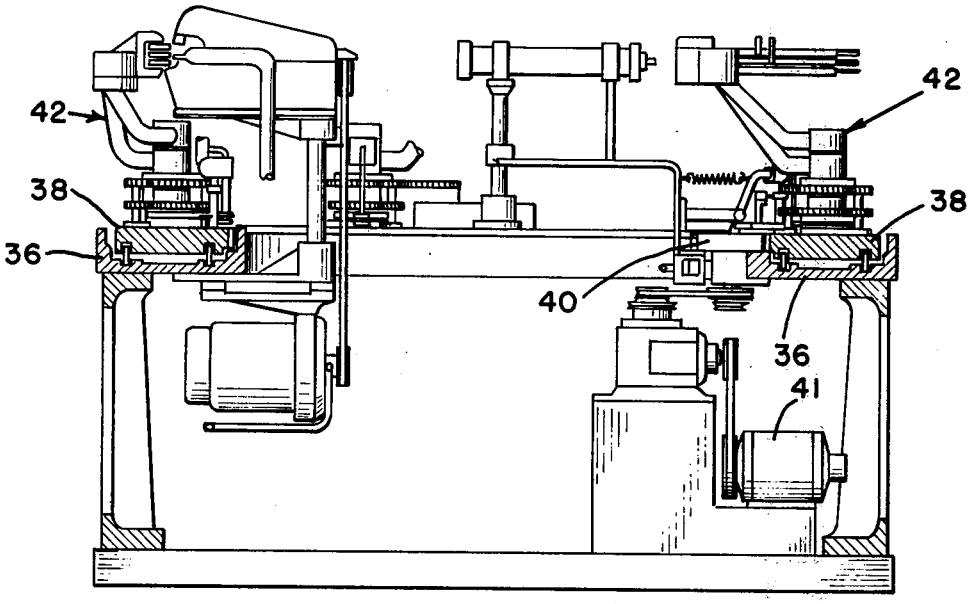
FIG. 2 is a fragmentary, schematic, side elevational view of the apparatus for forming panty hose garments having gussets.
Figure 3:
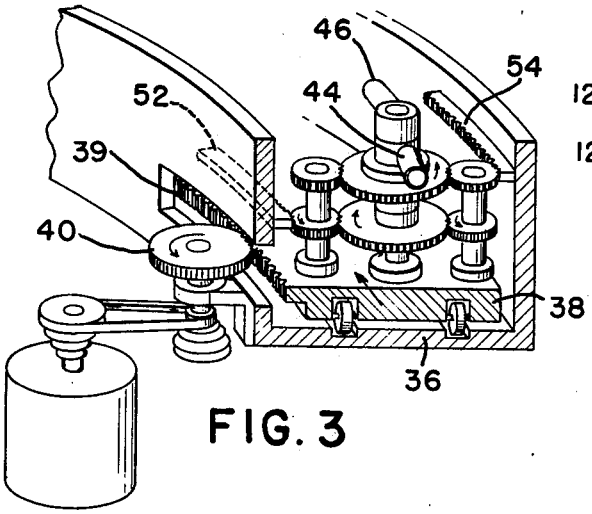
FIG. 3 is a fragmentary, perspective view of the mechanism for driving and rotating arms of a template unit.
Figure 7:
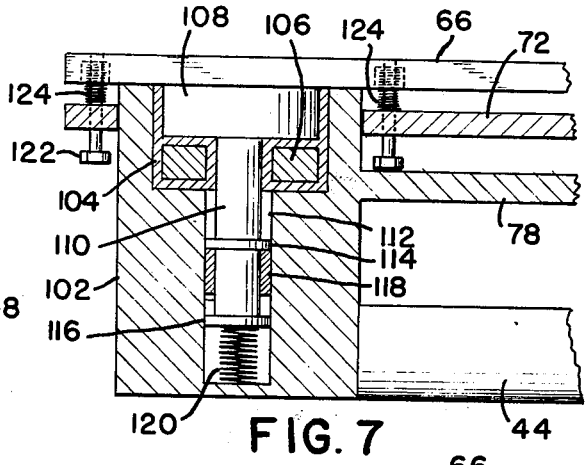
FIG. 7 is a fragmentary, side elevational view of a template assembly with the upper, central and lower clamps closed for clamping a pair of stocking materials.

FIGS. 1–3 illustrate the basic embodiment of the present invention. A stationary circular guide rail 36 supports a circular, displaceable carrier 38 as fully disclosed in the above-mentioned U.S. Pat. No. 3,777,681. The carrier 38 is provided with a rack 39 which meshes with a gear 40 driven by a motor 41 for rotating the carrier 38, all as described in the Horita patent.

As shown by FIG. 1, a plurality of template units 42 are supported upon the carrier 38 at equally spaced distances. Each template unit 42 includes upper and lower arms 44, 46, supported upon collars 43, 45, respectively, FIG. 5, which are rotated and controlled in the manner disclosed and as illustrated by FIG. 4A of the Horita patent and applicant's FIG. 3.

Racks are provided around the internal surfaces of the guide rail 36 to open and close the arms of each of the template units 42. The racks 48, 50, of FIG. 1, serve to close the arms of each template unit 42, while racks 52, 54 serve to open the arms of the template units as each unit is displaced beyond the racks in a clockwise manner.

The Horita patent discloses a single sewing machine for seaming goreless panty hose. In applicant's invention, two sewing machines have been provided. The machine 56, FIG. 1, is located and operates as disclosed by the Horita patent, while the machine 58 has been provided at a location spaced approximately 60° counterclockwise from machine 56. The operation of the two sewing machines will be later discribed.

The racks 52, 54 must be displaced counterclockwise approximately 60° from the machine 58 in order for the arms 44, 46 to fully open before they reach the machine 58.

Figure 5:
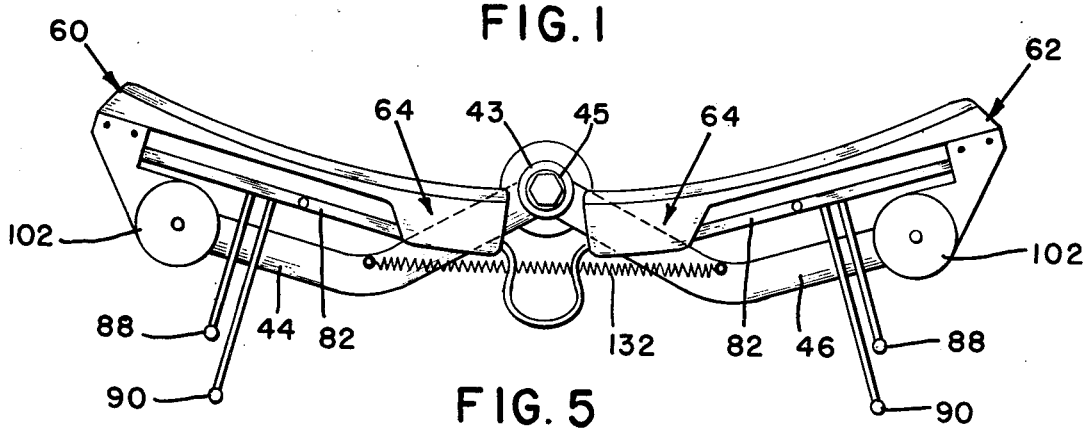
FIG. 5 is a schematic, top plan view of a template assembly with the arms and templates rotated to open positions and illustrating the cam followers attached to the templates.
Figure 4:
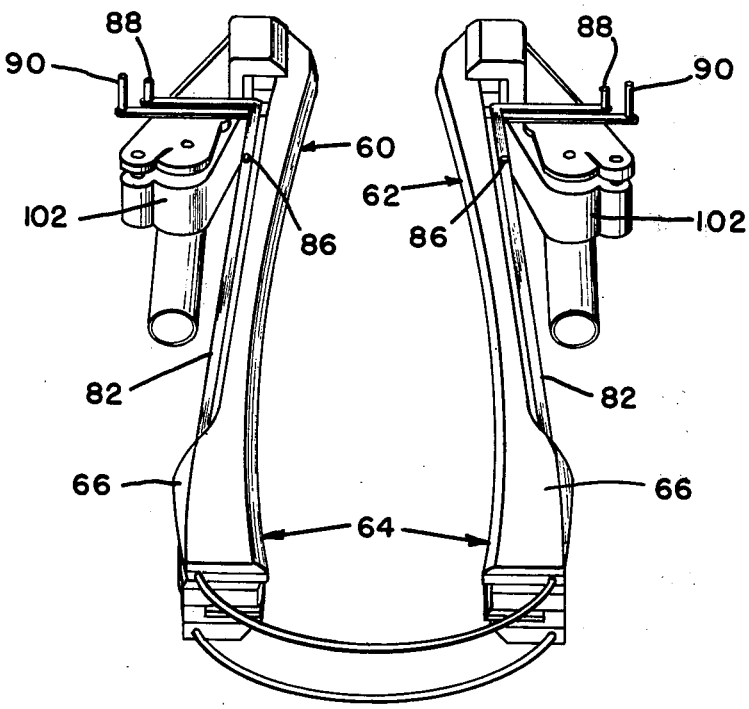
FIG. 4 is a schematic, perspective view of a template assembly of the present invention with the arms and clamps positioned to receive a pair of stocking materials.
Figure 13:
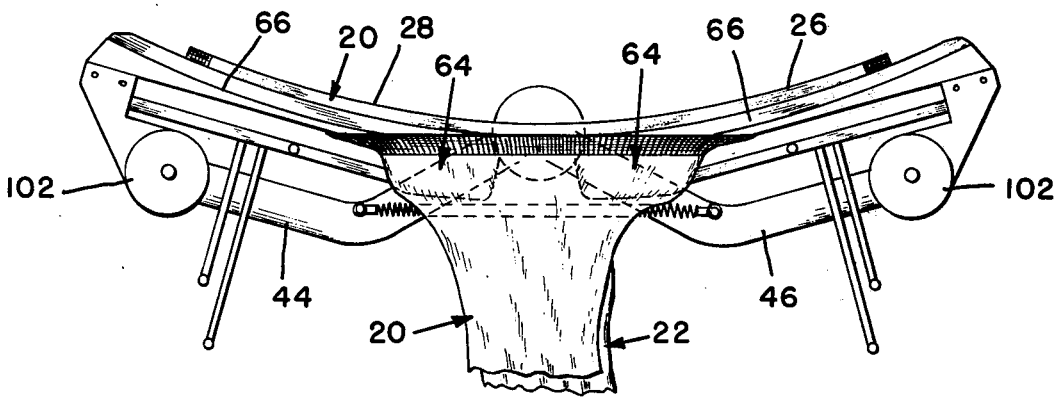
FIG. 13 is a schematic, fragmentary, top plan view of the apparatus illustrating the stretched, severed edges of the stocking materials prior to placing a gusset thereon.

The operation of the present invention will now be described briefly. An operator mounts stocking materials 20 and 22 upon the spaced template assemblies 60, 62 of a template unit 42 within the areas of Stations F or A with the arms closed as shown by FIG. 4. Template assemblies 60 or 62, each being mounted upon an arm 44 or 46, includes a compound clamp 64 which individually clamps each stocking material 20 and 22, a cam follower arrangement for shifting portions of the clamps, and a mechanism for opening and closing the clamps. The template unit 42 and clamped stocking materials are displaced clockwise and a cutter device 65 severs the stocking materials along line 24 of FIG. 9, within the area of Station B. Continued clockwise displacement of the template unit 42 passed the racks 52, 54 opens the arms as shown by FIG. 5 and at Station C of FIG. 1, resulting in a spreading of the severed edges 26, 28 of the stocking materials 20 and 22. The severed edges 26, 28 of each stocking material are displaced by the template assemblies 60, 62 to define generally straight lines as shown by FIG. 13. A gusset 30 is placed upon the stocking material manually or automatically as desired. The compound clamps 64 are actuated in such a manner as to move the severed edges 26, 28 of the uppermost stocking material 20 out of the way of the sewing instrumentalties 130 of the first sewing machine 58. The gusset then is sewn to the lowermost stocking material 22. The compound clamp then is actuated to shift the uppermost stocking material back to its original position and the gusset 30, uppermost stocking material 20 and the seam 32 are sewn by the second machine 56. Displacement of the template unit 42 past the racks 48, 50, intermediate Stations E and F, closes the arms 44, 46. The garment may be manually removed adjacent Station F by an operator. However, the garment preferably is automatically removed from the template unit as disclosed and illustrated by FIGS. 9A and 9B of the Horita patent.

The template assemblies 60 and 62 of each unit are right and left, being mirror images of each other, and each includes a compound clamp 64, a mechanism for opening and closing the clamp, apparatus for shifting the clamps, and a support arm 44 or 46.

Figure 6:
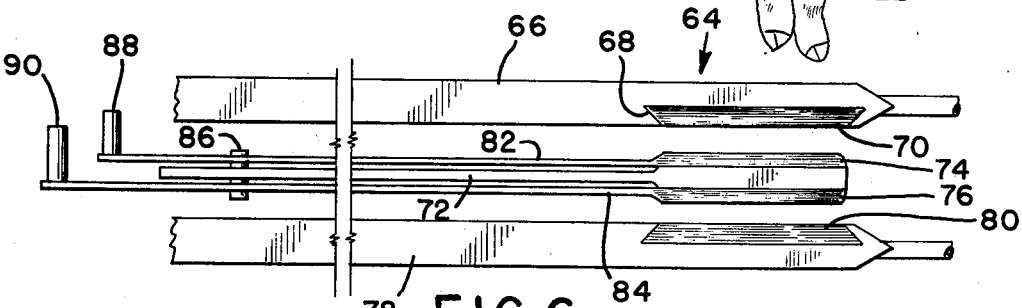
FIG. 6 is a fragmentary, schematic, side elevational view of the compound clamp and the cam follower and lever arrangement of the central clamp unit.

Referring particularly to FIGS. 4–6, each compound clamp 64 includes an elongated top member 66 defining a channel or track 68 for receiving a slide member 70, and elongated central unit 72 having upper 74 and lower 76 slides, and an elongated lower member 78 supporting a slide member 80. The angled walls of the channels or track retain the slide members upon the top, central and lower members while permitting reciprocal movement thereof as will be subsequently described. Spring means, not shown, may be provided for facilitating the ease of displacement of the slides. Preferably, the slide members are formed of Teflon. The upper and lower slide members 70 and 80 are free floating, while the intermediate slide members 76 and 74 are positively displaced by levers 84 and 82, respectively, which are pivoted about pin 86. The end of lever 82, remote to slide 74, is provided with a cam follower 88 while the lower lever 84 is provided with a cam follower 90.

Figure 17:
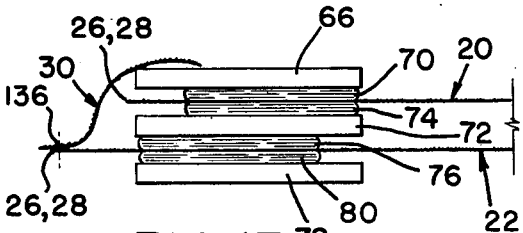
FIG. 17 is a view similar to FIG. 16 with the slides of the upper clamp displaced to draw the upper stocking material away from a first sewing machine to facilitate sewing of a gusset to the bottom or lowermost stocking material.

Upon displacement of the carrier 38, the arms 44, 46 are opened by racks 52, 54 and the cam follower 88 on arm 44 is positioned intermediate the spaced cams 92, 94. Continued rotation of the carrier 38 results in the cam follower 88 on arm 44 engaging cam 94, and subsequently cam follower 88 on arm 46 engaging cam 92. Displacement of the cam followers 88, 88 results in pivoting of the levers 82, FIG. 6, about pivot pin 86 and positive displacement of the slides 70, 74 of both cooperating compound clamps 64, 64 outwardly, in a direction way from the sewing machine 58. As shown by FIG. 17, the slides 70, 74 move to the right.

As a unit 42 continues to move towards the sewing machine 56 and through Station D, the cam followers 88, 88 engage cam 96 moving the top slides 70, 74 back to their original positions. Also the cam followers 90, 90 attached to levers 84, 84 engage cam 98 and pivot about pins 86 which displace the lower slides 76, 80, of each of the two compound clamps, outwardly away from the sewing instrumentalties of the machine 56. Thus, the slides 70, 74, 76, 80 are positioned as shown by FIG. 18.

Figure 16:
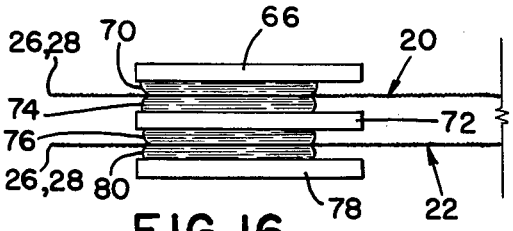
FIG. 16 is a schematic, elevational view of a compound clamp gripping a pair of stocking materials.
Figure 18:
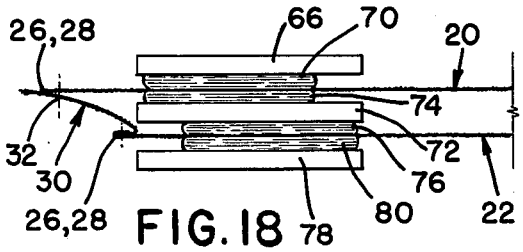
FIG. 18 is a view similar to FIGS. 16 and 17 with the slides and stocking material in the upper clamp returned to their original positions, while the lowermost stocking material and lowermost slides are withdrawn to automatically turn the gusset and position it for sewing to the uppermost stocking material and to completely seam the material severed sections.

Upon progression of the template unit 42 to Station E, a cam 100 pivots the cam followers 90, 90 to displace the lower slides 76, 80 from the FIG. 18 positions back to the original positions of FIg. 16.

Figure 8:
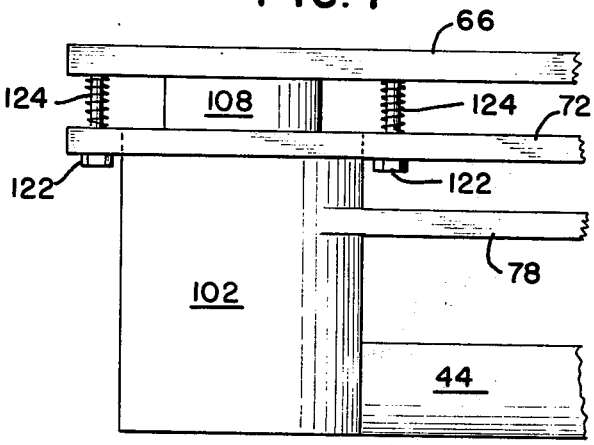
FIG. 8 is a view similar to FIG. 7 with the clamps open for receiving or removing stock materials.

The mechanism for opening and closing the compound clamps 64 will now be described. Since the template assembly 62 is a mirror image of the other template assembly 60, only the opening and closing operation of the compound clamp 64 of assembly 60, as shown by FIGS. 5–8 will be discussed. The elongated top member 66, central unit 72 and lower member 78 normally are vertically spaced, as shown by FIGS. 6 and 8, and adapted to receive a pair of stocking materials 20, 22. The lower elongated member 78 is secured to a cylinder 102 which is mounted upon arm 44. The cylinder 102 houses an electric actuator 104, an electromagnet 106 embedded therein, a flange 108 having a pole 110 secured thereto which slides within an opening 112 in the cylinder. Flanges 114, 116, attached to the pole 110, cooperate with an abutment 118 to limit sliding displacement of the pole within the cylinder. A compression spring 120 within the opening 112 engages the flange 116 and urges the pole 110, flange 108 and elongated top member 66 upwardly into the FIG. 8 position. When the electro-magnet 106 is activated, electric actuator 104 attracts the flange 108 pulling flange 108 and member 66 downwardly overcoming the force exerted by the spring 120. It is to be noted that the elongated upper member 66 is secured to the flange 108. The electric actuators 104 of both associated template assemblies 60, 62 are simultaneously energized approximately at Station A or other appropriate location after an operator positions the stocking materials 20 and 22 upon the compound clamps 64, 64. A microswitch, not shown, appropriately located upon the guide rail 36, is electrically connected to electric actuators 104, 104 of the template assemblies 60 and 62 of each of the units 42 as the units move from the loading station. The above clamping operation operates in the same manner as described in the Horita patent.

The elongated central member 72 supporting slides 74, 76 must be mounted to permit movement relative to the upper elongated member 66 and the lower member 78. To achieve this result, the central member 72 slides upon the outer surface of the cylinder 102 and is coupled to the upper member 66 by a plurality of fasteners 122 and compression springs 124. The fasteners 122 are fixed to upper member 66 while the central member 72 is freely slideable upon the fasteners. With the electric actuators 104 deenergized, the springs 124 separate members 66 and 72, as shown by FIG. 8, and vertically space the slides 70, 74. Activation of the electric actuators 104 moves the members 66, 72 from the FIG. 8 position to the FIG. 7 position compressing the springs 124 and bringing slide members 70, 74 and 76, 80 into contact with each other.

Severing of the stocking materials 20, 22 along line 24 is achieved by the cutter mechanism 65, FIG. 1. The cutter mechanism 65 turns in synchronism with the traveling of a template unit 42 from point X to point Y to avoid interruption of the movement of the unit 42. The cutting mechanism 65 operates in the same manner as illustrated by FIGS. 8A and 8B of the Horita patent and as disclosed between lines 37 of column 7 and line 26 of column 8 of the patent.

Perferably the completed panty hose is removed from the template unit 42 automatically at Station F by a doffing mechanism 126. The mechanism 126 is identical to and operates in the same manner as the removal mechanism disclosed between line 27 of column 8 and line 11 of column 9, and as illustrated by FIGS. 9A and 9B of the Horita U.S. Pat. No. 3,777,681.

Seaming one side of the gusset 30 to the lower stocking material 22 is accomplished by sewing instrumentalities 130 of conventional sewing machine 58. Sewing of the other side of the gusset 30 to the upper stocking material 20 and sewing of the edges 26, 28 of the materials to form seam line 32, FIG. 11, is accomplished by the sewing instrumentalties 130 of conventional sewing machine 56. A pneumatic suction nozzle 128 is located just upstream of each of the machines 56 and 58 to facilitate the seaming operations. The nozzles 128, 128 are connected to a suitable suction source, not shown. Suitable limit switches, not shown, are provided on the guide rail 36 at locations upstream of the nozzles for actuation by a template unit 42 as it moves toward each of the sewing machines.

It is to be noted that in the illustrated embodiment, six template units 42 have been provided for continuously circulating to the various stations A–F.

Figure 12:
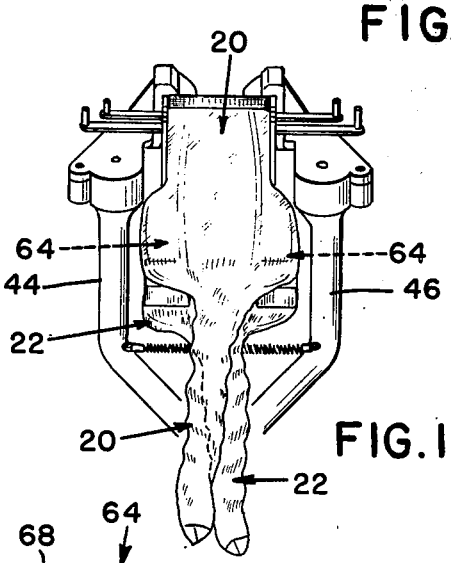
FIG. 12 is a fragmentary, perspective end view of a template assembly with a pair of stocking materials clamped in position.

The operation of the invention with respect to a single template unit 44 will now be described. Within the area of Station A, the compound clamps 64, 64 are in an opened condition, as shown by FIGS. 6 and 8, due to the springs 120 and 124, and the arms 44, 46 are closed, as shown by FIG. 4. An operator places a pair of stocking materials or leg section blanks 20, 22 within the compound clamps 64, 64 as shown by FIG. 12. The hip portions of material 20 extends between the spaced clamps 64, 64 with a section passing over top of the clamps 64, 64 and the portion extending between the compound clamps and located between the slides 70 and 74. The lower stocking material 22 extends around the lower clamp members 78 of each compound clamp and positioned between the slides 76, 80. The compound clamps are activated by the electric actuators 104, 104 to overcome springs 120, 124 and nip the upper material 20 between slides 70, 74 and the lower material 22 between slides 76, 80.

The clamped stocking materials 20, 22,having the hip portions aligned one above the other, are displaced from Station A towards Station B and the cutter mechanism 65 severs both blanks 20 and 22 along line 24, FIG. 9, a prescribed distance. The cutter mechanism 65 retracts and the arms 44, 46 are opened, to the position of FIG. 5, as a template unit advances beyond the racks 52, 54. An over-center spring 132 maintains the arms 44, 46 in an opened condition. However, locking pins 134, FIG. 1, may be provided, if desired, for cooperating with latches, not shown, on the template assemblies 60, 62 to retain the arms in the open condition.

Referring to FIG. 13, the severed edges 26, 28 of the aligned stocking blanks 20 and 22 extend inwardly of the compound clamps 66, 66 a distance of approximately one inch, and while being curved slightly, define a generally straight line. The severed edges 26, 28 should be positioned one above the other as shown by FIG. 16. As a template unit 42 continues to advance, the cam followers 88, 88 engage cams 92 and 94 and the slides 70, 74 of the compound clamps pull the edges 26, 28 of the upper stocking material 20 outwardly, as shown by FIG. 17, away from the sewing instrumentalties 130 of machine 58. Since the slides are positively moved and since the fabric 20 is clamped between slides 70, 74, it follows that the slide 70 also moves with the slide 74.

Figure 14:
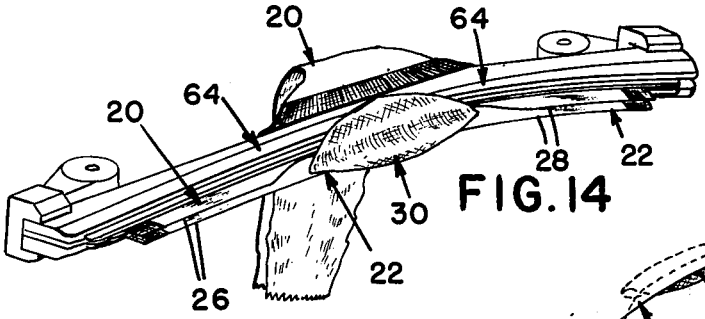
FIG. 14 is a schematic, perspective view of the apparatus after the stocking materials have been severed, the arms opened, the stocking materials clamped, and gusset material positioned for subsequent sewing operations.
Figure 15:
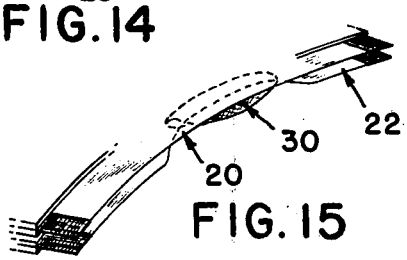
FIG. 15 is a perspective view illustrating gusset material that has been sewn to the lowermost of the two stocking materials and as it begins to turn over prior to sewing to the upper stocking material.

A gusset 30 is positioned as shown by FIGS. 17 and 14 and seamed at 136 for attachment to the lowermost stocking material 22 adjacent edges 26, 28. Prior to sewing, the gusset 30 normally is held in position by friction. However, Velcro may be applied to the upper members 66 of clamps 60, 62 to retain the gusset in position.

After the gusset has been sewn to the bottom material 22 it automatically turns over as the top slides 70, 74 return to their original positions and the lower slides 76, 80 are moved to the FIG. 18 positions. The lower stocking material is sewn at 136 only along one side of the gusset 30 and displacement of material 22 to the right, FIG. 18, pulls the lower portion of the gusset to the right, while displacement of the upper stocking material 20 to the left, FIG. 18, pushes against the upper portions of gusset 30. The width of the gusset is determined by the amount of pull or displacement of the center slides 74, 76. The vacuum nozzle 128, positioned adjacent machine 56, also facilitates turning of the gusset. Movement of the slides 70, 74 and slides 76, 80 from the FIG. 17 positions to the FIG. 18 positions is accomplished by the cams 96 and 98 acting upon followers 88, 90, respectively, prior to the template unit 42 and stocking materials reaching the sewing machine 56. The vacuum nozzle 128 adjacent sewing machine 56 moves the gusset 30 upwardly into engagement with edges 26, 28 of stocking material 20 so as to form a seam line 32 by machine 56. Note FIG. 18. The second machine 56 sews the unsewn side of the gusset and the top and bottom stocking materials forming seam line 42, FIG. 11, resulting in the completed panty hose garment.

The unit continues movement towards Station E and cam 100 returns the lower slides 76, 80 to the positions of FIG. 16. At Station E the electric actuators 104 of both template assemblies 60 and 62 are deactivated releasing the clamp pressure permitting the springs 120 and 124 to open the clamps. The completed panty hose garment is automatically doffed at Station F.

Figure 19:
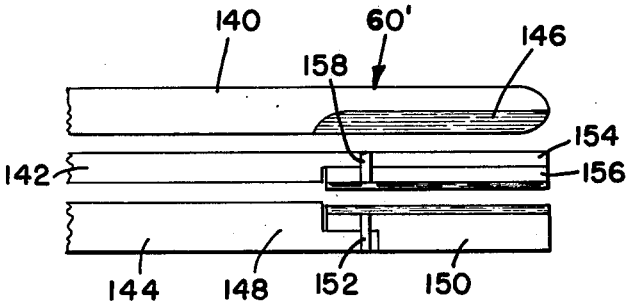
FIG. 19 is a fragmentary, schematic side elevational view of a modified clamp arrangement.

FIG. 19 illustrates a modified compound clamp 64' including an upper member 140, a central member 142, and a lower member 144. The three members are opened and clamped as previously described with respect to the apparatus of FIGS. 7 and 8. The upper member 140 is rigid having a gripping jaw 146 of rubber or other suitable material. The lower member has a rigid portion 148 with a displaceable jaw 150 hinged thereto by pin 152. The central member 142 includes an upper rigid or fixed jaw 154 and a displaceable jaw 156 hinged thereto by a pin 158. The upper stocking material 20 would be clamped between stationary jaws 146, 154 and the lower stocking material 22 would be clamped between the pivoted jaws 150, 156. In operation, the lower jaws move the severed edges 26, 28 of the lower materials 22 outwardly and the gusset is sewn thereto similarly to FIG. 18. The jaws 150, 156 are retracted and the second machine 56 sews the upper and lower materials 20 and 22 and the gusset 30 to form panty hose. The jaws 150, 156 would be pivoted by cam followers and cams in a manner as previously described.

Figure 20:
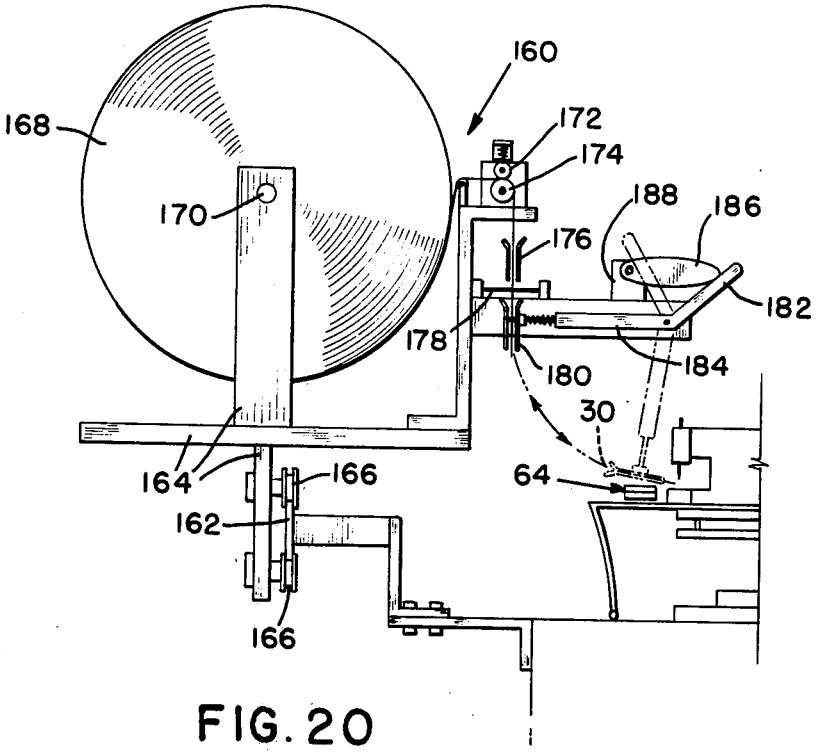
FIG. 20 is a schematic, side elevational view of a mechanism for feeding gusset material to the stocking materials prior to sewing.
Figure 21:
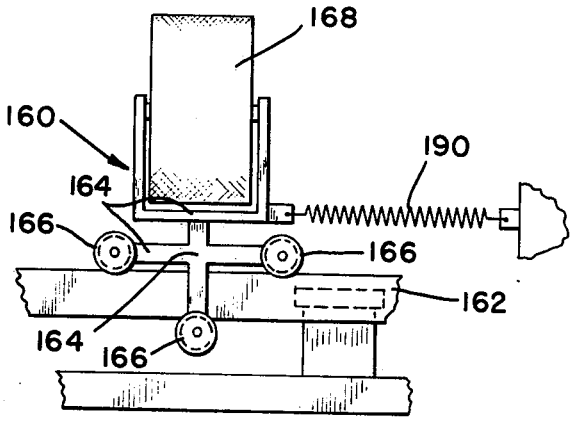
FIG. 21 is a fragmentary, rear elevational view of the feeding mechanism of FIG. 20.

FIGS. 20 and 21 illustrate an assembly 160 for automatically supplying and feeding gussets to the proper positions for attachment to the stocking materials. The entire assembly 160 is supported from the machine frame and is displaceable along a track 162 curved to conform to the curvature of the machine frame. The assembly 160 includes a support frame 164 having rollers 166 mounted thereon for engagement with track 162. A roll of gusset material 168 is rotatably supported upon a shaft 170 secured to the frame 164.

The gusset material 168 is directed between a pressure roll 172 and a drive roll 174, thru spaced guides 176, beyond a slitting mechanism 178 and to a sandwich-type clamp 180, which may be operated in a conventional manner. A pivoted feeding linkage 182, 184 is controlled by a cam 186 and cam motor 188 to feed a gusset into position upon the compound clamps 64, 64 for subsequent sewing, in the manner previously described, to stocking materials retained by the clamps 64.

In operation, a drive motor rotates the roll 174 a predetermined distance to feed the gusset material into the clamp 180. The clamp 180 is actuated and slitting mechanism 178 severs a length of gusset material from roll 168. The cam motor 188 is activated which rotates cam 186 and permits the feeding linkage 182, 184 to carry the gusset to the appropriate position upon the compound clamps 64. The clamp 180 releases the gusset and continued rotation of the cam 186 returns the feeding linkage back to its origional position. The drive motor may be activated by means of a microswitch from a template unit 42 as the unit 42 is displaced passed station C, FIG. 1. Since the unit 42 rotates continuously, the entire assembly at 160 must be driven along tract 162 a prescribed distance while the gusset is being positioned. Movement of the assembly 160 along the track may be accomplished by a linkage, not shown, attached to the assembly for engaging a template unit 42. After a prescribed movement, the linkage would disengage the template unit permitting a spring 190 to return the assembly 160 to its initial position.

What is claimed is:

1. Apparatus for sewing a gusset in a pantyhose garment comprising:

means for supporting and clamping a pair of stockings, each of said pair of stockings having severed edges, with the severed edges of said pair of stockings being aligned in generally superposed relation, said means including a compound clamp having first and second pairs of gripping elements, each pair of elements adapted for receiving therebetween and gripping a single stocking, and means mounting the gripping elements of one pair of said first and second pairs of elements for displacement relative to the other pair of gripping elements;

means for displacing at least portions of the severed edges of one stocking, of said pair of stockings, in a preselected direction relative to the severed edges of the other stocking;

first and second sewing means; and means for conveying said pair of stockings to said first sewing means for sewing a portion of a gusset to the severed edges of one said stocking of said pair of stockings, and to said second sewing means for sewing a portion of the gusset to the severed edges of the other stocking of said pair of stockings.

2. Apparatus as recited in claim 1, said means for supporting and clamping the pair of stockings including first and second template assemblies adapted to have the pair of stockings mounted thereon, said template assemblies being disposed opposite one another with corresponding portions of said pair of stockings being disposed between said template assemblies.

3. Apparatus as recited in claim 2, wherein each of said template assemblies includes a clamp having pluralities of discrete jaws for individually gripping each of said pair of stockings.

4. Apparatus as recited in claim 3, wherein at least one jaw of said plurality of discrete jaws, of the clamps of each of said template assemblies, includes a portion mounted for displacement for facilitating displacement of portions of the severed edges of one stocking and a preselected direction relative to the severed edges of the other stocking.

5. Apparatus as recited in claim 4, wherein each of said template assemblies further includes means for displacing said clamps between opened and closed positions.

6. Apparatus for seaming a panty hose garment comprising: a support frame, a carrier means mounted for displacement upon said support frame, first and second oppositely disposed clamps for mounting thereon first and second stockings, each of said stockings having hip portions disposed between said clamps in superposed relation, means for severing the stocking hip portions along a predetermined line to define severed edges, means, mounted upon said carrier means, individually supporting each of said first and second clamps for relative movement toward and away from each other, means for displacing said clamps away from each other resulting in spreading of the stocking severed edges to define a generally straight line, each of said first and second clamps including displaceable slides for gripping at least one stocking of said first and second stockings, means for selectively displacing said slides for shifting at least predetermined portions of the severed edges of one stocking in a prescribed direction relative to the severed edges of the other stocking, and means for sewing a gusset to the severed edges of first one and then the other of said first and second stockings.

7. Apparatus as recited in claim 6, wherein said means for sewing a gusset to the severed edges of the stockings includes a first mechanism for seaming the gusset along one side to the severed edges of the one stocking, and a second mechanism for seaming the gusset to the severed edges of the other stocking and for seaming the severed edges of the stockings not sewn to the gusset.

8. Apparatus as recited in claim 6, and further including means for automatically positioning a gusset adjacent said severed edges and said first and second clamps prior to sewing.

9. Apparatus as recited in claim 6, wherein a plurality of oppositely disposed clamps are supported upon said carrier means in predetermined, spaced relation.

10. Apparatus as recited in claim 6, wherein said means for selectively displacing said slides includes cam means mounted upon said support frame, and cam follower means attached to said first and second clamps.

11. A method for seaming panty hose comprising the steps of:

providing a pair of stockings having hip portions;

retaining corresponding portions of the hip portions in adjacent, superposed relation;

severing the adjacent corresponding portions of said hip portions along a predetermined line to define front and rear severed edges of said hip portions;

spreading both hip portions of said stockings until both severed edges of each stocking are disposed in a generally straight line;

positioning a gusset adjacent the severed edges; and sewing the gusset along one edge to the severed edges of a first stocking of said pair of stockings and sewing together the remaining severed edges of said pair of stocking along with the unsewn edge of the gusset.

12. The method as recited in claim 11, wherein the corresponding hip portions of the pair of stockings are individually retained on a template assembly, and the hip portions of said stockings are spread by spreading members of said template assembly.

13. The method as recited in claim 11, and further including the step of shifting at least portions of the severed edges of one stocking, of said pair of stockings, relative to the severed edges of the other stocking prior to seaming.

14. The method as recited in claim 12, wherein the sewing together the remaining severed edges of said pair of stockings along with the unsewn edge of the gusset are performed continuously.

15. The method as recited in claim 14, and further including shifting at least portions of the severed edges of one stocking, of said pair of stockings, relative to the severed edges of the second stocking prior to sewing the gusset along one edge, and again shifting said portions of the severed edges of said one stocking prior to continuously seaming together the remaining severed edges with the unsewn edge of the gusset.

16. A method for seaming a pair of stockings, each having severed edge portions, with a gusset to form a panty hose garment comprising the steps of:

clamping corresponding severed edge portions of a pair of stockings in adjacent, superposed relation;

displacing at least a segment of the clamped, severed edge portions of one stocking relative to the clamped severed edge portions of the other stocking;

sewing a gusset along one edge to the severed edge portions of one of the stockings; and sewing the unattached edge of the gusset and the remaining unsewn severed edges of the pair of stockings.

17. The method as recited in claim 11 in which the seaming step includes the steps of seaming said gusset to a portion of the severed edges of one stocking and then continuously seaming said gusset and the remaining severed edges of said one stocking to the severed edges of the other stocking while maintaining said front and rear edges in generally straight line condition.

18. Apparatus for sewing a gusset on a pantyhose garment comprising:

means for supporting and clamping a pair of stockings, each of said pair of stockings having severed edges with the severed edges of said pair of stockings being aligned in superposed relation;

first and second sewing means;

means for conveying said pair of stockings to said first sewing means for sewing a portion of a gusset to the severed edges of one said stocking of said pair of stockings and to said second sewing means for sewing a portion of the gusset to the severed edges of the other stockings of said pair of stockings; and means for displacing at least a portion of the severed edges of said other stocking relative to the severed edges of said one stocking before said pair of stockings is conveyed to said first sewing means to permit sewing of the gusset to said one stocking, and thereafter for displacing at least a portion of the severed edges of said one stocking relative to the severed edges of said other stocking before said pair of stockings is conveyed to said second sewing means to permit sewing of the gusset to said other stocking.

19. Apparatus as recited in claim 18, wherein said means for supporting and clamping a pair of stockings includes first and second template assemblies adapted to have the pair of stockings mounted thereon, said template assemblies being disposed opposite one another with corresponding portions of said pair of stockings being disposed between said template assemblies.

20. Apparatus as recited in claim 18, further including means for retaining in position a gusset to permit sewing a portion of said gusset to the severed edges of one stocking of said pair of stockings with said first sewing means, and to permit sewing a portion of said gusset to the severed edges of the other stocking of said pair of stockings with said second sewing means.

21. Apparatus for sewing a gusset in a pantyhose garment comprising:

means for supporting and clamping a pair of stockings, each of said pair of stockings having severed edges with the severed edges of said pair of stockings being aligned in generally superposed relation;

displacement means for displacing at least a portion of the severed edges of one stocking of said pair of stockings relative to the severed edges of the other stocking;

first and second sewing means;

means for conveying said pair of stockings to said first sewing means for sewing a portion of a gusset to the severed edges of one said stocking of said pair of stockings, and to said second sewing means for sewing a portion of the gusset to the severed edges of the other stocking of said pair of stockings; and means for activating said displacement means to displace at least a portion of the severed edges of said other stocking away from said first sewing means when said pair of stockings is conveyed to said first sewing means to permit sewing of the gusset to said one stocking, and for displacing at least a portion of the severed edges of said one stocking away from said second sewing means when said pair of stockings is conveyed to said second sewing means to permit sewing of the gusset to said other stocking.

* * * * *

UNITED STATES PATENT AND TRADEMARK OFFICE

CERTIFICATE OF CORRECTION

PATENT NO. : 4,188,898

DATED : February 19, 1980

INVENTOR(S) : Cecil R. Bell, Jr. et al.

It is certified that error appears in the above—identified patent and that said Letters Patent is hereby corrected as shown below:

Col. 1, lines 30, 32, and
Col. 3, lines 35, 43 and 47, in all occurrences, change "patent" to --Patent--.
Col. 4, line 24, cnange "patent" to --Patent--.
Col. 5, line 4, change "FIg" to --FIG--.
Col. 8, line 21, correct spelling of "original".
Col. 10, line 13, change "12" to --11--.

Signed and Sealed this

*Fourteenth* Day of *July 1981*

[SEAL]

*Attest:*

GERALD J. MOSSINGHOFF

*Attesting Officer*

*Commissioner of Patents and Trademarks*